US007134389B2

(12) United States Patent
Murakami

(10) Patent No.: US 7,134,389 B2
(45) Date of Patent: Nov. 14, 2006

(54) SCREEN PRINTING APPARATUS

(75) Inventor: Takehiko Murakami, Minamimachi (JP)

(73) Assignee: Minami Co., Ltd. (JP)

( * ) Notice: Subject to any disclaimer, the term of this patent is extended or adjusted under 35 U.S.C. 154(b) by 0 days.

(21) Appl. No.: 10/891,071

(22) Filed: Jul. 15, 2004

(65) Prior Publication Data

US 2005/0000374 A1 Jan. 6, 2005

(30) Foreign Application Priority Data

Feb. 22, 2002 (JP) ..... 2002-045489
Jul. 31, 2003 (JP) ..... 2003-283809

(51) Int. Cl.
*B41L 13/00* (2006.01)

(52) U.S. Cl. ..... 101/118; 101/116

(58) Field of Classification Search ..... 101/116–120
See application file for complete search history.

(56) References Cited

U.S. PATENT DOCUMENTS 3,557,690 A * 1/1971 Voegelin ..... 101/120
3,565,002 A * 2/1971 Boehm ..... 101/116
3,599,565 A * 8/1971 Feier et al. ..... 101/116
3,892,176 A * 7/1975 Van der Winden ..... 101/116
3,960,076 A * 6/1976 Wick ..... 101/119
3,986,451 A * 10/1976 Zimmer ..... 101/127.1
4,103,615 A * 8/1978 Cruz et al. ..... 101/120
4,911,069 A * 3/1990 Hayama et al. ..... 101/120
5,035,177 A * 7/1991 Zimmer ..... 101/425
5,642,663 A * 7/1997 Hara ..... 101/116
5,650,009 A * 7/1997 Himes et al. ..... 118/213
6,263,791 B1 * 7/2001 Sato ..... 101/116
6,318,254 B1 * 11/2001 Saitoh et al. ..... 101/116
6,619,207 B1 * 9/2003 Claassen ..... 101/424
6,640,702 B1 * 11/2003 Watanabe et al. ..... 101/115
6,718,872 B1 * 4/2004 Kanno ..... 101/118
6,886,457 B1 * 5/2005 Shoji ..... 101/128.4

* cited by examiner

*Primary Examiner*—Ren Yan
(74) *Attorney, Agent, or Firm*—Bacon & Thomas PLLC

(57) ABSTRACT

An efficiency is further improved in comparison with a conventional manual operation by automatically applying a material to a film-like body by a machine. A film-like body is delivered from a supply apparatus and is taken up by a take-up apparatus. A material is applied by a squeegee of a squeegee apparatus in the middle of the above, and is heated and dried by a reflow apparatus and an application of the material is executed by a rotation of a screen mask supported to a mask support body in a cylindrically wound state in correspondence to a moving speed of the film-like body, a slidable contact of the squeegee of the squeegee apparatus installed in an inner portion of the screen mask with an inner surface of the screen mask, and a downward extrusion of the material.

2 Claims, 2 Drawing Sheets

SCREEN PRINTING APPARATUS

TECHNICAL FIELD

The present invention relates to a screen printing apparatus, and more particularly to a screen printing apparatus structured such as to rotate a screen mask in a cylindrically wound state at a predetermined speed and extrudes a material by a squeegee installed in an inner portion of the screen mask and arranged at a predetermined position, thereby applying the material to a surface of a film-like body.

BACKGROUND ART

In the case of applying a predetermined material to the surface of the long film-like body all over the surface, the application has been conventionally carried out by a manual operation using a brush or a spray.

However, in the case that the application is carried out by the manual operation using the brush or the spray, there is a problem that too much labor hour and time are required. Further, since the material is too thin by only one application, it is necessary to recoat again and again, and an operation efficiency is low.

DISCLOSURE OF THE INVENTION

The present invention is made by taking the points mentioned above into consideration, and an object of the present invention is to provide a screen printing apparatus structured such as to automatically and efficiently apply a predetermined material to a long film-like body by a machine.

In accordance with a main aspect of the present invention, there is provided a screen printing apparatus for applying a predetermined material to a long film-like body which is delivered from a supply apparatus and is taken up by a take-up apparatus, wherein a screen mask is supported in a state in which the screen mask is cylindrically wound around a mask support body borne rotatably in a vertical direction by bearing rollers constituted by a pair of parallel annular bodies of the same size and arranged so as to be positioned on a diagonal line in an outer peripheries of the respective annular bodies, a squeegee apparatus and a printing material supplying apparatus are installed in an inner portion of the screen mask, and a squeegee of the squeegee apparatus is arranged at a position opposing to a bed plate roll arranged to a lower surface of the film-like body, thereby rotating the screen mask along a moving direction of the film-like body and in correspondence to a moving speed of the film-like body.

Further, in the structure mentioned above, the structure may be made such that the bed plate roll is appropriately moved in the moving direction of the film-like body and a direction of moving close to and apart from the film-like body. In the case of the structure mentioned above, it is possible to adjust a clearance between the squeegee and the film-like body, to correspond to a thickness of the film-like body, and to adjust an amount of the applied material.

Further, in the structure mentioned above, the structure may be made such that a cleaner unit for wiping a work-up of the screen mask is arranged at an appropriated position in a rotational direction of the screen mask. In the case of the structure mentioned above, it is possible to avoid waste in labor hour and time required for cleaning the screen mask by frequently stopping the operation of a whole of the apparatus.

The present invention is structured as mentioned above, and the material is extruded to the long film-like body which is delivered from the supplying apparatus and is taken up by the take-up apparatus, and the material is pushed out by the squeegee in the inner portion of the screen mask which rotates in correspondence to the moving speed of the film-like body, to print the material on the film-like body. Since the application is automatically carried out by the machine, a lot of labor hour and time which have been required in the conventional manual operation are not required. Further, since a necessary and sufficient amount of material is applied at a stroke, it is not necessary to recoat as in the prior art, and it is possible to widely improve an efficiency.

Further, in the case that the bed plate roll is structured such that the bed plate roll can appropriately move in the moving direction of the film-like body and the direction of moving close to and apart from the film-like body, it is possible to adjust a clearance between the squeegee and the film-like body, it is possible to correspond to the thickness of the film-like body, and it is possible to adjust the amount of the applied material.

Further, in the case that the cleaner unit for wiping the work-up of the screen mask is arranged at the appropriated position in the rotational direction of the screen mask, it is possible to avoid waste in labor and time required for cleaning the screen mask by frequently stopping the operation of a whole of the apparatus.

BEST MODE FOR CARRYING OUT THE INVENTION

In accordance with a best mode for carrying out the present invention, the material is extruded to the long film-like body which is delivered from the supplying apparatus and is taken up by the take-up apparatus, by the squeegee in the inner portion of the screen mask which rotates in correspondence to the moving speed of the film-like body, and the material is printed on the film-like body. Accordingly, a lot of labor and time which have been required in the conventional manual operation are not required, it is not necessary to recoat as in the prior art, and it is possible to widely improve an efficiency.

DESCRIPTION OF THE PREFERRED EMBODIMENT

Figure 1:
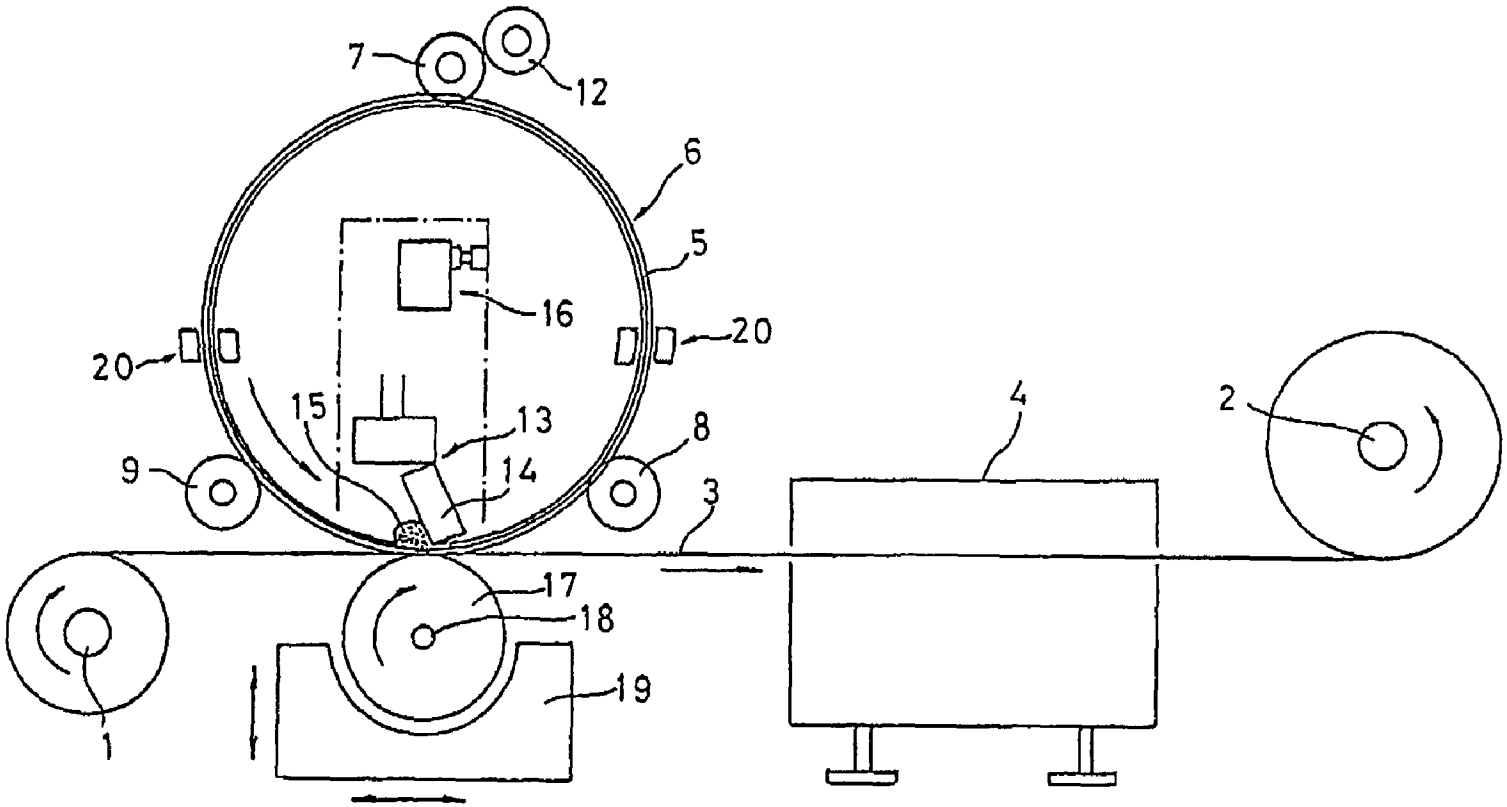
FIG. 1 is a schematic view of an embodiment 1 in accordance with the present invention.
Figure 2:
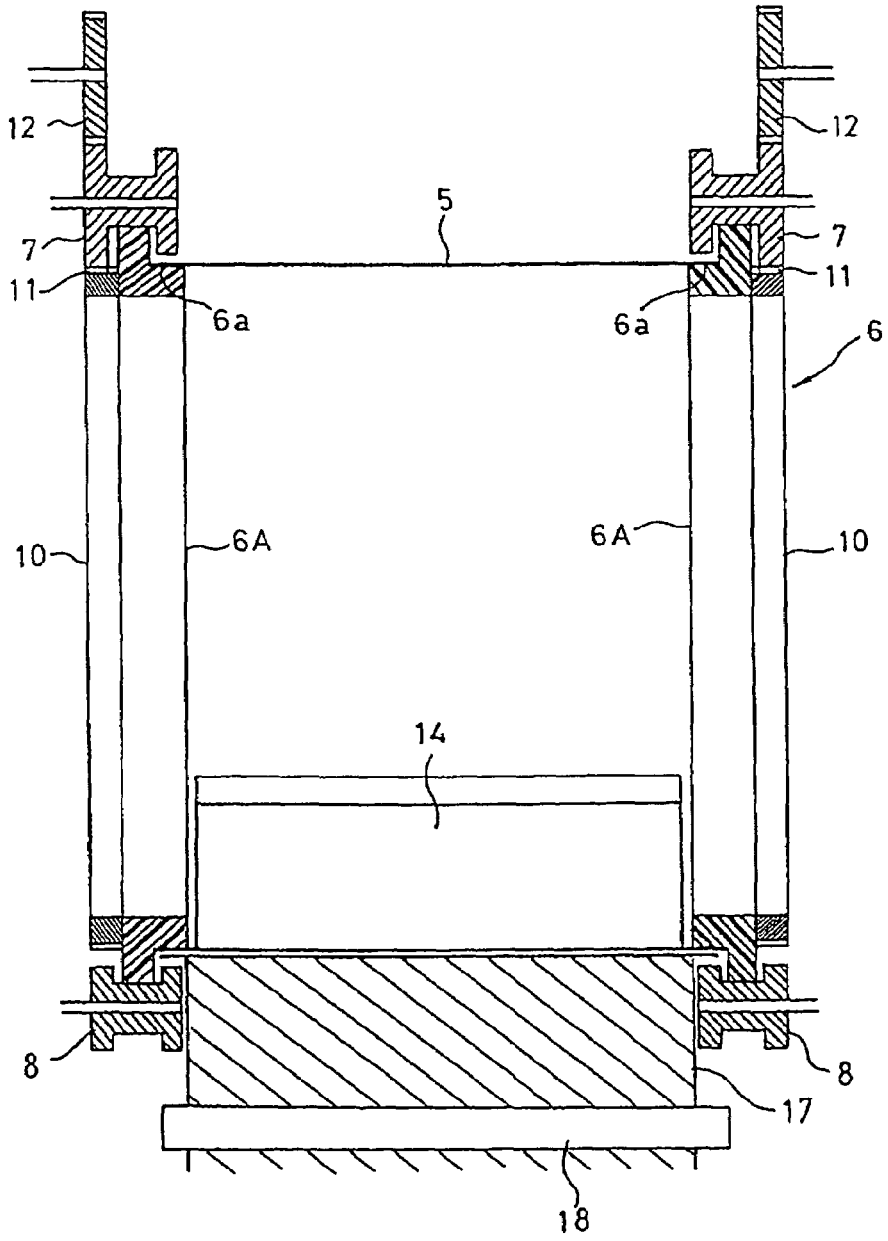
FIG. 2 is a vertical cross sectional view of a main portion in accordance with the present invention.

In the drawings, reference numeral 1 denotes a supplying apparatus and reference numeral 2 denotes a take-up apparatus. Reference numeral 3 denotes a long film-like body which is delivered from the supplying apparatus 1 and is taken up by the take-up apparatus 2. Reference numeral 4 denotes a reflow apparatus for heating the film-like body after being printed and drying the applied material.

Reference numeral 5 denotes a screen mask. Further, the screen mask 5 employs a structure constituted by a stainless net for applying the material to a whole surface of the film-like body, in the present embodiment. Further, the screen mask 5 is supported in a state of being wound cylindrically around a mask support body mentioned below.

Reference numeral 6 denotes a mask support body. The mask support body 6 is constituted by a pair of parallel annular bodies 6A and 6A having the same size, is borne so as to freely rotate in a vertical direction by bearing rollers 7, 8 and 9 which are arranged so as to be positioned on a diagonal line in an outer peripheries of the respective annular bodies 6A and 6A, and fixes the screen mask 5 to step portions 6*a* and 6*a* formed on inner sides of the annular bodies 6A and 6A. Further, annular gears 10 and 10 are firmly fixed to outer sides of the annular bodies 6A and 6A, the gears 10 and 10 are meshed with gears 11 and 11 provided in an outer periphery of the bearing roller 7, and the gears 11 and 11 are meshed with gears 12 and 12 connected to a drive source such as a motor or the like.

Reference numeral 13 denotes a squeegee apparatus which is installed in an inner portion of the screen mask 5 supported to the mask support body 6 in a state of being wound cylindrically. The squeegee apparatus 13 is structured such that a squeegee 14 thereof is slidably contacted with an inner surface of the screen mask 5 at right under the position in the drawing. Reference numeral 15 denotes a material which is supplied by a printing material supplying apparatus 16 installed in an inner portion of the screen mask 5.

Reference numeral 17 denotes a bed plate roll which is rotatably borne to a support table 19 by a support axis 18 and which is arranged at a position opposing to the squeegee 14 of the squeegee apparatus 13 in a lower surface of the film-like body 3. Further, the bed plate roll 17 is structured such that a position thereof can be moved appropriately in a moving direction of the film-like body 3 and a direction of moving close to or apart from the film-like body 3, as shown by arrows in the drawing.

Reference numerals 20 and 20 denote a cleaner unit arranged at an appropriate position in a rotational direction of the screen mask 5, and is provided for wiping a work-up of the screen mask 5.

Next, a description will be given of an operation of the embodiment 1 mentioned above.

The film-like body 3 is delivered from the supply apparatus 1 and is taken up by the take-up apparatus 2. The film-like body 3 is structured such that the material 15 is applied by the squeegee 14 in the middle thereof, and the film-like body 3 is heated and dried by the reflow apparatus 4. Further, the application of the material 15 is executed by the rotation of the screen mask 5 in correspondence to the moving speed of the film-like body 3, the slidable contact of the squeegee 14 of the squeegee apparatus 13 installed in the inner portion thereof with the inner surface of the screen mask 5, and the downward extrusion of the material 15.

What is claimed is:

1. A screen printing apparatus wherein a long film-like body is supplied continuously from a supply apparatus to a take-up apparatus on a substantially straight predetermined printing path, wherein the long film-like body is taken up continuously by said take-up apparatus, and wherein a printing material is applied through a screen mask to said long film-like body between said supply apparatus and said take-up apparatus, the screen printing apparatus comprising:

a mask support body including a pair of annular bodies that have the same outer diameters and are spaced axially away from each other in parallel;

a plurality of bearing rollers disposed on the outer peripheries of said annular bodies and spaced away from each other at a given distance on the outer peripheries, the bearing rollers supporting said mask support body;

a cylindrical screen mask mounted on the outer peripheries of said annular bodies;

a bed plate roll opposed to said cylindrical screen mask and rotatably supported on a support table so that said long film-like body can move in a direction tangential to the outer periphery of said screen mask on the printing path as said long film-like body contacts with a part of the outer periphery of said cylindrical screen mask, said bed plate roll being displaceable in a straight moving direction of said long film-like body and in a direction perpendicular to said straight moving direction;

a squeegee apparatus disposed inside said cylindrical screen mask to oppose said bed plate roll;

a printing material supplying apparatus disposed inside said cylindrical screen mask to supply said printing material near to said squeegee; and rotary means for rotating said mask support body in accordance with a moving speed of said long film-like body.

2. A screen printing apparatus according to claim 1, further comprising a cleaner unit disposed along the rotary direction of said cylindrical screen mask for wiping a work-up of said cylindrical screen mask as said cleaner unit contacts a part of said screen mask.

* * * * *

UNITED STATES PATENT AND TRADEMARK OFFICE

CERTIFICATE OF CORRECTION

PATENT NO. : 7,134,389 B2
APPLICATION NO. : 10/891071
DATED : November 14, 2006
INVENTOR(S) : Takehiko Murakami It is certified that error appears in the above-identified patent and that said Letters Patent is hereby corrected as shown below:

On the title page, in Item (30), under Foreign Application Priority Data:

Please delete "Feb. 22, 2002 (JP) ..... 2002-045489"

Signed and Sealed this

First Day of May, 2007

JON W. DUDAS
*Director of the United States Patent and Trademark Office*